US005651744A

United States Patent [19]

Millon et al.

[11] Patent Number: 5,651,744

[45] Date of Patent: Jul. 29, 1997

[54] LACROSSE STICK HAVING OFFSET HANDLE

[75] Inventors: Mark Millon; David W. Fream, both of Baltimore, Md.

[73] Assignee: STX, Inc., Baltimore, Md.

[21] Appl. No.: 673,684

[22] Filed: Jun. 25, 1996

[51] Int. Cl.[6] ..... A63B 59/02

[52] U.S. Cl. ..... 473/513

[58] Field of Search ..... 273/326, 67 A, 273/67 R, 72 R, 72 A, 75

[56] References Cited

U.S. PATENT DOCUMENTS

| | | | |
|---|---|---|---|
| 2,935,323 | 5/1960 | Cummings | 273/326 |
| 3,545,755 | 12/1970 | Owada | 273/73 |
| 4,037,841 | 7/1977 | Lewis | 273/96 |
| 4,038,719 | 8/1977 | Bennett | 16/110 R |
| 4,138,111 | 2/1979 | Rule | 273/326 |
| 4,147,348 | 4/1979 | Lee | 273/73 |
| 4,206,918 | 6/1980 | Lewis | 273/326 |
| 4,351,528 | 9/1982 | Duplin | 273/67 A |
| 4,544,157 | 10/1985 | Curtis | 273/67 A |
| 4,659,080 | 4/1987 | Stoller | 273/75 |
| 4,739,994 | 4/1988 | Lewis | 273/326 |

OTHER PUBLICATIONS

Washington Star–News—Jan. 17, 1974, p. D1.

*Primary Examiner*—Mark S. Graham

*Attorney, Agent, or Firm*—Connolly and Hutz

[57] ABSTRACT

A lacrosse stick having an offset handle with an angular deviation of up to 90 degrees with respect to the longitudinal axis of the handle to provide improvement in grip, handling, and playing characteristics. Location and dimensions of the offset are critical to provide desired balance and weight distribution and thereby, new and improved lacrosse stick performance.

12 Claims, 3 Drawing Sheets

LACROSSE STICK HAVING OFFSET HANDLE

BACKGROUND OF THE INVENTION

Lacrosse is an ancient game which originated with the American and Canadian Indians. Traditionally, lacrosse stick handles were made of wood, usually hickory, shaped by the American and Canadian Indians. These handles, being rather roughly handcrafted and susceptible to the elements, lacked uniformity as to quality, weight, strength and feel in the hands of the players. Moreover, being handmade, such lacrosse sticks were often in short supply.

To overcome the disadvantages of the prior art, great strides have been made in the recent past in the design and construction of lacrosse stick heads and handles. For example, U.S. Pat. Nos. 3,507,495; 3,822,062, and 3,905,088 to Tucker et al; and U.S. Pat. No. 4,034,984 to Crawford et al disclose elastomeric lacrosse stick heads and parts which are highly resilient and have dramatically revolutionized the sport of lacrosse. In the 1970's, handles of metallic construction as described in U.S. Pat. No. 4,037,841 were first developed. These metal handles, in large measure, replaced the wooden lacrosse stick handles, particularly in the men's game. More recently, as described in U.S. Pat. No. 4,739,994, lacrosse stick handles have been proposed comprising graphite loaded plastics. Today, lacrosse stick handles of aluminum, chrome, aluminum alloy, titanium and composite material are available on the market. Accordingly, it is now common for lacrosse stick heads and handles to be interchangeable in order to suit the different needs and playing styles of each player, or for repair of a broken head or handle.

Up until now, most lacrosse stick handle improvements were directed to the use of new and different materials with minor additional modification such as knurling or the like as described in U.S. Pat. No. 4,206,918. All handles were very basic in their shape, generally circular, octagonal or hexagonal in cross section and all were straight from end to end. Although the straight handles have proved highly satisfactory, as proven by the universal acceptance of these handles, it has now been determined that due to the degree of competition and the superior skill among present day lacrosse players, an offset handle provides unique advantages as to better ball control, faster shots, improved balance and weight distribution and a more comfortable feel in the hands of a player.

In the 1980's, two Canadian players crudely bent their handles in an attempt to lower the scoop of the head (i.e., the transverse wall connecting the sidewalls) in relation to the plane of the lacrosse stick handle. However, these bent handles were disallowed by the National Collegiate Athletic Association, which will not permit players to alter handles in any fashion. Other efforts to lower the scoop in relation to the plane of the handle or increase the depth of a ball pocket have been to curve or bend the sidewalls and scoop of the plastic or elastomeric head. One disadvantage of these curved or lowered heads is that the curve or bend creates weaknesses in the plastic or elastomeric head which requires reinforcement that adds substantial weight to the head. Further disadvantages are that a curved or lowered head creates such a deep pocket that it can be more difficult to play with and does not allow a player to more easily grip the handle and feel the benefits of a head below the plane of the handle.

SUMMARY OF THE INVENTION

The present invention is directed to an improved lacrosse stick having an offset handle with an angular deviation of up to 90 degrees with respect to the longitudinal axis of the stick, which provides a natural grip and improved handling characteristics.

Another object of this invention is to provide an improved lacrosse stick handle in combination with any lacrosse stick head that lowers the ball from the handle's axis of rotation, which provides an improved player feel and better ball control.

A still further object of this invention is to provide a better-balanced lacrosse stick with a desirable weight distribution between the stick head and handle such that the head will naturally return to a neutral or open position. This position provides the requisite player feel, which facilitates cradling, throwing and receiving a ball. Furthermore, the offset handle's natural rotation to an open position minimizes the chances of a player unintentionally receiving a thrown ball with the wrong side of a lacrosse head.

A still further object of this invention is to provide a lacrosse stick handle which can be adapted to any lacrosse stick head.

A further object of this invention is to provide a lacrosse stick handle which provides for faster shots, a greater optimization of the power transfer between the player and the lacrosse stick head and handle, and an overall superior performing lacrosse stick compared to those now in use.

Other objects of the invention will become apparent from the following description and the accompanying drawings.

BRIEF DESCRIPTION OF THE DRAWINGS

Novel features and advantages of the present invention in addition to those discussed above will become apparent to persons of ordinary skill in the art from a reading of the following detailed description in conjunction with the accompanying drawings where in similar reference characters refer to similar parts and in which.

DETAILED DESCRIPTION OF THE INVENTION

Figure 1:
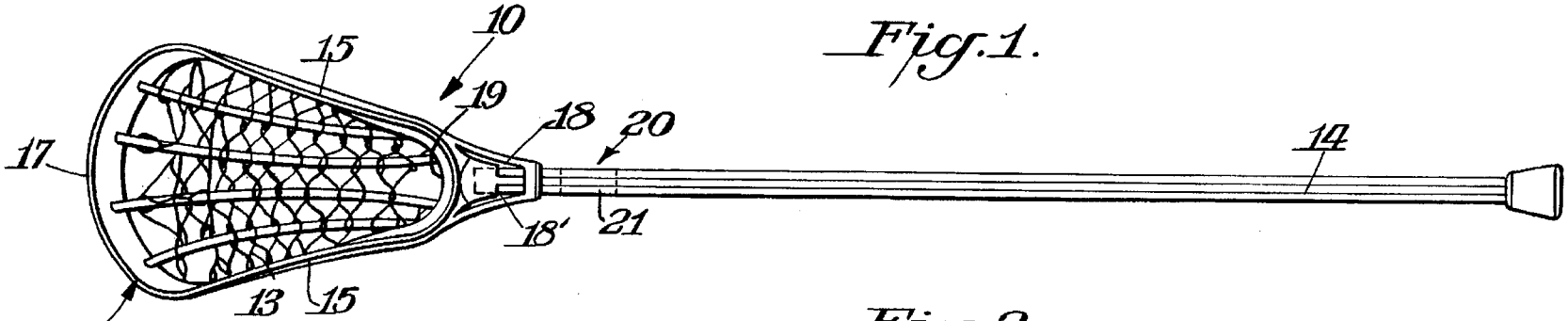
FIG. 1 is a top plan view of a lacrosse stick with an offset handle in accordance with the invention.
Figure 2:
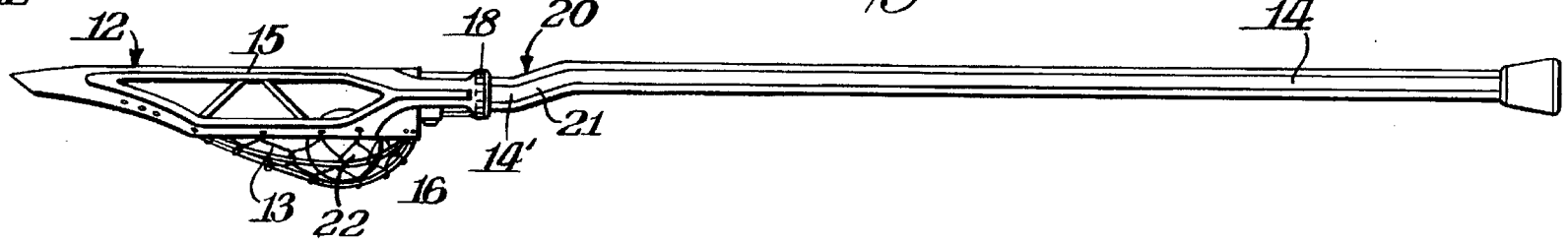
FIG. 2 is a side elevational view of the lacrosse stick shown in FIG. 1.

Referring now to the drawings in detail, it will be seen that there is illustrated in FIGS. 1 and 2, a lacrosse stick 10 which includes a head 12 and a replaceable handle 14. The head is provided with a webbing or netting 13.

The head 12 may be constructed similarly to a head disclosed in the Tucker et al U.S. Pat. No. 3,507,495 and also in a later Tucker et al U.S. Pat. No. 3,822,062. The details of these patents is incorporated herein by reference thereto. An additional head suitable for use with the present invention is disclosed in pending application Ser. No. 08/392,688 filed Sep. 20, 1985 for "Lacrosse Stick Having Open Sidewall Structure", and the details thereof are incorporated herein by reference thereto. Accordingly, the details of the head 12 will be broadly described hereinafter.

The head 12 can be an open or closed frame construction with a generally V-shape design preferably substantially symmetrical. The bottom or lower end of the head is formed as a throat 18 from which two sidewalls 15, 15 are inclined and diverge upwardly and are connected by a transverse top or end wall 17, commonly referred to as the "scoop". It is to be noted that the transverse wall 17 is of an upwardly arched construction, is twisted generally from the planes of the sidewalls 15, 15 and is disposed in a plane slightly inclined with respect to the general plane of the head 12 so as to facilitate the fielding of ground balls. Webbing or netting 13 is connected to the head to provide the pocket 16 in which the game ball 22 may be caught and carded and from which it may be thrown.

A transverse stop 19 extends generally about the sidewalls 15, 15 and which cooperates with the throat 18 and adjacent portions of the sidewalls 15, 15 to facilitate the mounting of the head 12 on the handle 14, this area generally constituting a throat area 18' which may selectively have an open or closed center. Alternatively, the head 12 may be directly connected to the handle 14 and within the context of this invention, the area of connection may be considered the throat.

Figure 3:
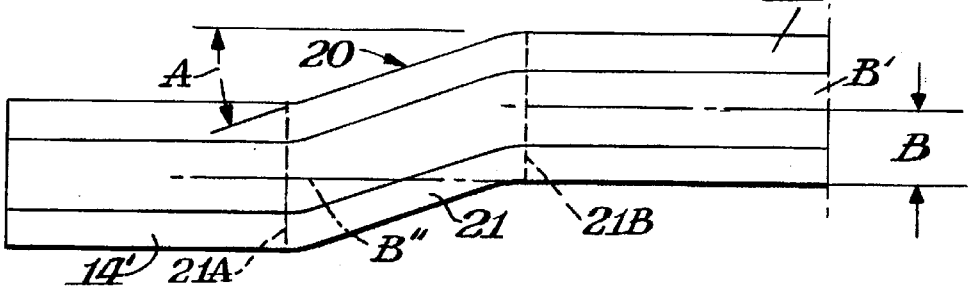
FIG. 3 is a fragmental side elevational view of a preferred embodiment of an offset handle.
Figure 4:
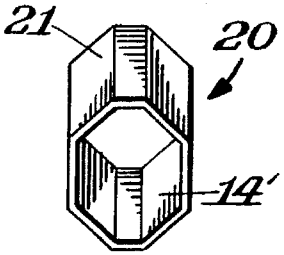
FIG. 4 is a left end elevational view of the lacrosse stick shown in FIG. 3.

The invention, as above noted, is primarily related to the handle 14, although the correlation between the head and the handle is a further aspect of the invention. The handle 14 may be formed of a variety of materials including wood, metals, such as aluminum, chrome, alloys and titanium, fiberglass, plastics and composite materials. As shown in FIG. 2, the handle 14 is connected to the throat 18 by an offset extension 20. As shown in FIGS. 2 and 3, the offset extension 20 includes a front extension 14', which is preferably straight and parallel to handle 14, which connects to and is aligned with throat 18. Alternatively, the front extension may be slightly angled or there may be no front extension 14' with the inclined or angled portion 21 of the offset connecting directly to throat 18. The offset extension is preferably a smooth curve as shown in FIGS. 2 and 3 as it permits the hand of the player to slide easily along the handle. Although illustrated as an octagon, as shown in FIGS. 2 and 4, the handle 14 may possess any desirable cross-sectional area such as oval, elliptical, octagonal or other.

Figure 9:
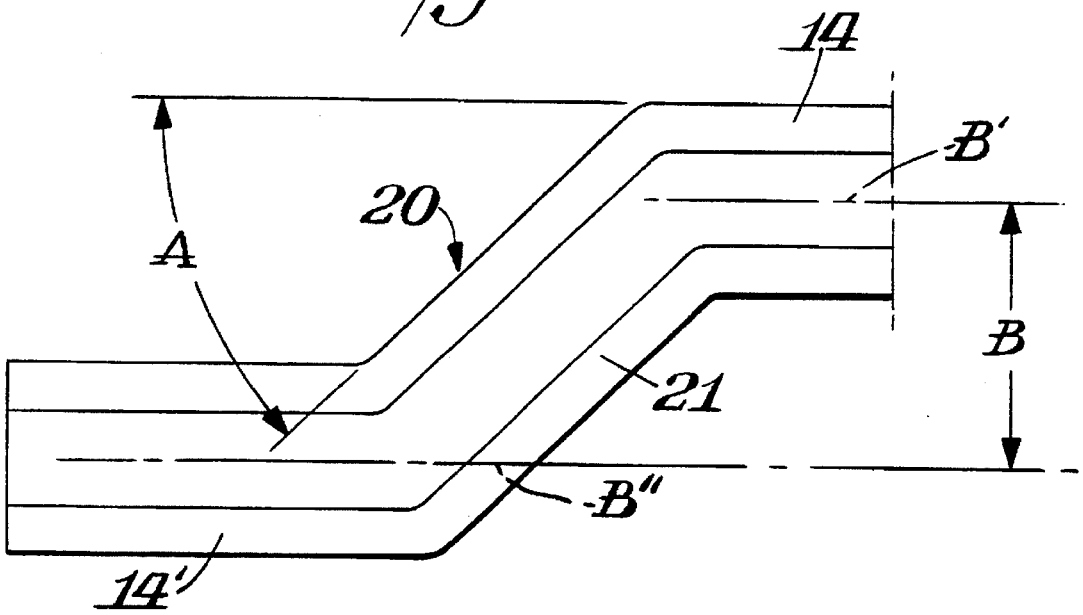
FIG. 9 is a fragmental side elevational view of another embodiment of the invention.
Figure 10:
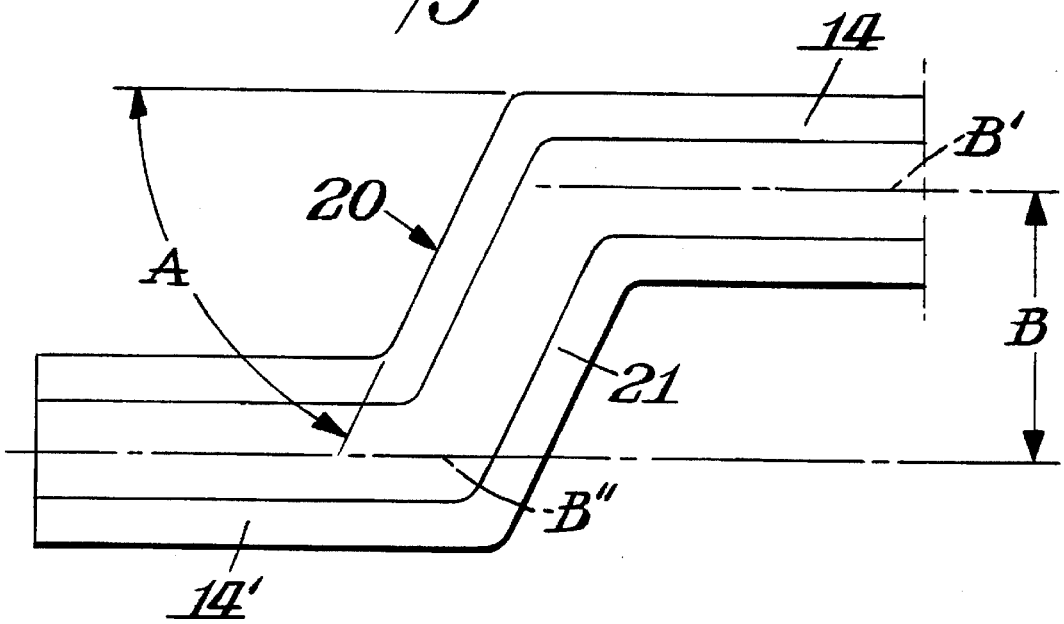
FIG. 10 is a fragmental side elevational view of still another embodiment of the invention.

The offset extension 20 is best shown in FIG. 3. Specifically, a lacrosse stick of the invention has an offset with an angular deviation A with respect to the longitudinal axis of the handle 14 of about 1 to 90 degrees and a drop distance B of about 0.10 to 2.00 inches as determined by measuring the distance between the centerline B' of the handle 14 and the centerline B" of the front extension of the offset which is aligned with throat 18 of the head 12. Stated another way, the drop distance B may be measured as the distance between the centerlines of the vertical dashed lines 21A and 21B at each end of the inclined portion 21 of the offset extension 20. For example, as illustrated, the centerline B', and B" are also the centerlines for the respective ends of inclined portion 21. While the angular deviation A and the corresponding drop distance B may vary depending on the specific characteristics desired for the lacrosse stick, it has been found that an angular deviation A of about 15 to 25 degrees and a drop distance B of about 0.4 to 0.7 inches are preferred ranges. A preferred embodiment, as shown in FIG. 3, has an offset with an angular deviation A of 19 degrees and drop distance B of about 0.533 inches. Other embodiments are shown in FIGS. 9 and 10. FIG. 9 depicts an offset with an angular deviation A of 43 degrees and a drop distance B of about 1.437 inches. FIG. 10 illustrates another embodiment of an offset with an angular deviation A of 64 degrees and a drop distance B of about 1.45 inches.

Figure 5:
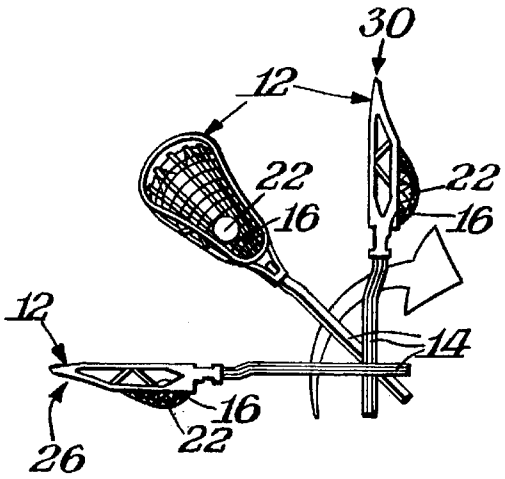
FIG. 5 is an illustration of the force of rotation motion of a lacrosse stick.

Referring now to FIG. 5, with an offset handle of the invention, the lacrosse ball 22 is cradled further from the axis of rotation than with a non-offset stick. As a result, as the head is rotated, the force securing the ball 22 in the pocket is increased and the player experiences an improved sense of ball control. This allows a player to be more effective in maneuvering the stick (through cradling and dodging) around opposing players in pursuit of the goal and makes it more difficult for a defensive player to dislodge the ball from an offensive player's stick. These improved handling characteristics are fundamental aspects of the lacrosse game.

An additional feature of the invention as shown in FIG. 5 is that an offset handle 14 provides an improved weight distribution between the head 12 and handle 14 with more mass below the handle's center of rotation. This causes the head 12 to return to a neutral position in a horizontal plane, i.e. the head almost parallel with the ground and the face of the head skyward 26. This is the desired position to begin play and orients a player to begin maneuvering the stick, whether that be to cradle while running, dodging, passing or shooting. In this position, the player can best feel the ball 22 in the pocket 16 of his stick and the ball is better positioned to pass or shoot, so he has a playing advantage.

Another feature of the invention is that an offset handle also tends to open up the face of the head when the stick is perpendicular to the ground 30. This is the desired position to receive a thrown ball. This feature is related to the longer moment arm associated with an offset handle, and the resultant force from the ball's impact in the pocket 16. With an offset handle of the invention, the center line of the handle 14 is in front of the plane of the head 12, generating forces that make the head 12 want to return to an open position 30 relative to the path of the ball rather than remain twisted. This is a significant advantage in lacrosse because of the constant stick rotation and effort required to present an open-faced head in the direction of a thrown ball and the frequency with which a ball will strike the inner sidewall. With the offset handle the head will more readily return to an open position and the ball is more likely to enter the strung pocket 16 rather than bouncing out of the head frame.

Figure 6:
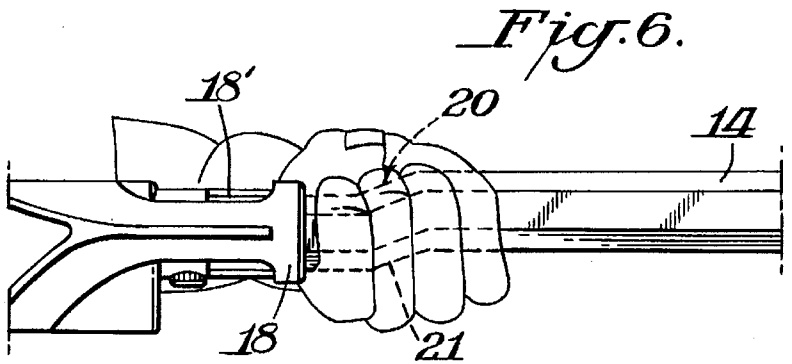
FIG. 6 is a fragmental side elevational view showing the hand grip position on the lacrosse stick offset in accordance with this invention.

Referring now to FIG. 6, the forefinger of the player's hand sometimes rests against or just below throat 18 with the throat 18 acting as a stop. The distance between throat 18 and the start of the inclined portion of offset extension 20 is less than the fisted hand span of an average player. As shown in FIG. 6, the forefinger is positioned in the offset and at least some of the remaining fingers are around the straight portion of the handle 14. The distance between the throat and the start of the inclined portion of the offset extension could vary for different size players and for different length handles, i.e., attack or defense. Generally, the distance should be no greater than one-third of the entire length of a given handle, measured from the point at which the handle connects to the throat to the opposite end of the handle. This feature provides a natural grip which permits the player to rest his forefinger in the offset extension. Because of this feature, the player has improved stick and bail control and can throw the bail harder, faster and more accurately, resulting in a much faster game with more accurate passes and shots on goal.

Another feature of the invention is that an offset handle creates an improved and more natural "scoop". Scooping is performed by lowering the lacrosse head 12 to the playing surface at the angle required to get under the ball and secure it in the pocket 16. With an offset handle, the degree to which a player must bend to the playing surface is reduced and he or she can scoop the ball better and with less effort (even with just one hand on the stick).

Figure 8:
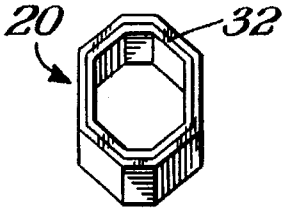
FIG. 8 is a right end elevational view of the lacrosse stick shown in FIG. 7.
Figure 7:
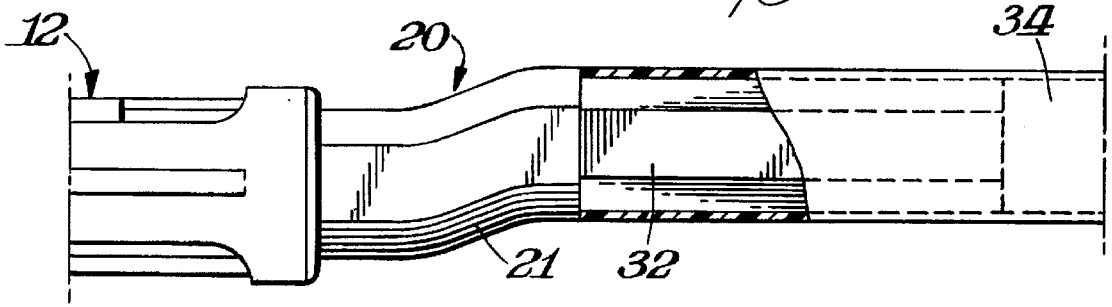
FIG. 7 is a fragmental side elevational view of a modified offset handle to retrofit to a standard lacrosse stick.

Referring now to FIGS. 7 and 8, an alternative embodiment of the invention is the offset extension is an attachment 32 which may be used to retrofit a standard straight handle lacrosse stick 34. When the invention is used to retrofit, the standard stick 34 would be removed from the throat 18 of the head 12 so that the attachment 32 could be mounted to the head 12 and to the stick handle 34. This permits an otherwise standard stick (i.e. head and handle) to be used with the advantages of the invention. This aspect of the invention may be practiced where the attachment 32 fits over the stick handle 34 like a sleeve, not shown in the drawings, or where the attachment telescopes into the handle and/or throat for securing the parts together as shown in FIGS. 7 and 8. Alternatively, the embodiment of FIGS. 7 and 8 may be practiced where a standard head is mounted to a modified handle having an integral offset attachment as in FIGS. 1–4 or where the offset attachment is integral with the head for being mounted to a standard handle.

The invention may be broadly practiced with variations using only some features of the invention such as in varying the location of the offset. Preferably, however, the offset is located near the throat 18.

While the invention has been particularly shown and described with reference to preferred embodiments thereof, it will be understood by those of ordinary skill in the art that various changes in form and details may be made without departing from the spirit and scope of the invention as defined in the appended claims.

We claim:

1. In a lacrosse stick having a head with a handle connected to the head, the improvement being in that the handle is connected to the head by an offset extension having an inclined portion to thereby offset the handle from the head, the handle and the head being parallel to each other, and the offset extension including opposite ends with centerlines and having an angular deviation of up to 90 degrees with respect to the longitudinal axis of the handle.

2. The lacrosse stick of claim 1, wherein the distance between the centerlines of each end of the inclined portion is about 0.10 to about 2.00 inches.

3. The lacrosse stick of claim 1, wherein the angular deviation is in the range of about 15 to 25 degrees.

4. The lacrosse stick of claim 3, wherein the distance between the centerlines of each end of the inclined portion is about 0.4 to about 0.7 inches.

5. The lacrosse stick of claim 1, wherein a throat is located at the junction of the head and the handle, and the distance between the throat and the top of the inclined portion of the offset extension is less than one-third the length of a given handle.

6. The lacrosse stick of claim 5, wherein the distance between the centerlines of each end of the inclined portion is about 0.10 to about 2.00 inches.

7. The lacrosse stick of claim 5, wherein the angular deviation is the range of about 15 to 25 degrees.

8. The lacrosse stick of claim 7, wherein the distance between the centerlines of each end of the inclined portion is about 0.4 to about 0.7 inches.

9. In a lacrosse stick having a head with a handle connected to the head, the improvement being in that the handle is connected to the head by an offset extension having an inclined portion to thereby offset the handle from the head, the offset extension being located at the junction of the head to the handle and including opposite ends with centerlines, and the offset extension having an angular deviation of up to 90 degrees with respect to the longitudinal axis of the handle.

10. The lacrosse stick of claim 9, wherein the distance between the centerlines of each end of the inclined portion is about 0.10 to about 2.00 inches.

11. The lacrosse stick of claim 9, wherein the angular deviation is in the range of about 15 to 25 degrees.

12. The lacrosse stick of claim 11, wherein the distance between the centerlines of each end of the inclined portion is about 0.4 to about 0.7 inches.

* * * * *